US009601246B2

(12) United States Patent
Sugiyama et al.

(10) Patent No.: US 9,601,246 B2
(45) Date of Patent: Mar. 21, 2017

(54) METHOD OF MANUFACTURING MAGNET, AND MAGNET

(71) Applicant: JTEKT CORPORATION, Osaka-shi, Osaka (JP)

(72) Inventors: Kazuhisa Sugiyama, Okazaki (JP); Toshiyuki Baba, Kashihara (JP)

(73) Assignee: JTEKT CORPORATION, Osaka (JP)

( * ) Notice: Subject to any disclaimer, the term of this patent is extended or adjusted under 35 U.S.C. 154(b) by 755 days.

(21) Appl. No.: 13/771,887

(22) Filed: Feb. 20, 2013

(65) Prior Publication Data

US 2013/0222093 A1 Aug. 29, 2013

(30) Foreign Application Priority Data

Feb. 27, 2012 (JP) ..... 2012-040137

(51) Int. Cl.
*H01F 1/01* (2006.01)
*H01F 1/059* (2006.01)
(Continued)

(52) U.S. Cl.
CPC ..... *H01F 1/01* (2013.01); *C22C 38/001* (2013.01); *C22C 38/005* (2013.01);
(Continued)

(58) Field of Classification Search
CPC ... H01F 1/01; H01F 1/08; H01F 1/065; H01F 1/0596; H01F 7/02; C22C 38/001; C22C 38/005
See application file for complete search history.

(56) References Cited

U.S. PATENT DOCUMENTS 4,968,529 A 11/1990 Hamamura et al.
5,234,771 A 8/1993 Mohri et al.
(Continued)

FOREIGN PATENT DOCUMENTS

CN 101447330 A 6/2009
EP 0 481 224 A1 4/1992
(Continued)

OTHER PUBLICATIONS

Nov. 7, 2013 Extended Search Report issued in European Patent Application No. 13 15 6393.4.
(Continued)

*Primary Examiner* — Jessee Roe
*Assistant Examiner* — John Hevey
(74) *Attorney, Agent, or Firm* — Oliff PLC

(57) ABSTRACT

A hard magnetic material formed of material powders made of a R—Fe—N compound containing a light rare earth element as R, or material powders made of a Fe—N compound is used as material powders. There is formed a compact in which a density of the hard magnetic material powders differs between an outer face side portion and an inside portion of the compact such that a rate of progress of powder bonding due to microwave heating is higher in the inside portion of the compact than in the outer face side portion of the compact when an outer face of the compact is irradiated with microwaves. Then, the outer face of the compact is irradiated with the microwaves to cause the microwave heating, thereby bonding the hard magnetic material powders by oxide films which are formed on the hard magnetic material powders.

3 Claims, 4 Drawing Sheets

(51) Int. Cl.

| | |
|---|---|
| ***H01F 1/06*** | (2006.01) |
| ***H01F 1/08*** | (2006.01) |
| ***H01F 7/02*** | (2006.01) |
| ***C22C 38/00*** | (2006.01) |

(52) U.S. Cl.

CPC ..... *H01F 1/0596* (2013.01); *H01F 1/065* (2013.01); *H01F 1/08* (2013.01); *H01F 7/02* (2013.01)

(56) References Cited

U.S. PATENT DOCUMENTS

| | | | | |
|---|---|---|---|---|
| 5,279,785 | A | 1/1994 | Mohri et al. | |
| 5,762,841 | A * | 6/1998 | Shimai | C04B 38/007 264/44 |
| 5,886,077 | A * | 3/1999 | Takahashi | C08K 3/08 148/101 |
| 6,317,020 | B1 | 11/2001 | Nakagawa et al. | |
| 6,326,087 | B1 * | 12/2001 | Nishiuchi | H01F 41/026 428/469 |
| 7,541,561 | B2 * | 6/2009 | Thyssen | B22F 3/105 219/678 |
| 2002/0144753 | A1 | 10/2002 | Yoshimura et al. | |
| 2002/0197512 | A1 | 12/2002 | Aizawa et al. | |
| 2003/0062097 | A1 * | 4/2003 | Shimada | B82Y 25/00 148/101 |
| 2009/0081067 | A1 | 3/2009 | Nakamura | |
| 2010/0261038 | A1 | 10/2010 | Imaoka et al. | |
| 2010/0289366 | A1 | 11/2010 | Komuro et al. | |
| 2011/0227424 | A1 | 9/2011 | Yoshida et al. | |
| 2011/0267167 | A1 | 11/2011 | Ogawa et al. | |
| 2012/0091832 | A1 * | 4/2012 | Soderberg | C08J 3/00 310/44 |
| 2013/0222094 | A1 | 8/2013 | Baba et al. | |
| 2013/0342298 | A1 | 12/2013 | Baba et al. | |
| 2014/0374643 | A1 | 12/2014 | Mio et al. | |

FOREIGN PATENT DOCUMENTS

| | | | | |
|---|---|---|---|---|
| EP | 2 228 808 | A1 | 9/2010 | |
| EP | 2 631 918 | A2 | 8/2013 | |
| EP | 2 680 280 | A1 | 1/2014 | |
| JP | 47-34193 | B | 8/1972 | |
| JP | 60-54406 | | 3/1985 | |
| JP | 62-206801 | A | 9/1987 | |
| JP | 63-217601 | A | 9/1988 | |
| JP | 63-254702 | A | 10/1988 | |
| JP | H05-214463 | A | 8/1993 | |
| JP | H10-72603 | A | 3/1998 | |
| JP | 2000-034503 | A | 2/2000 | |
| JP | 2000-104104 | A | 4/2000 | |
| JP | 2004-319602 | A | 11/2004 | |
| JP | 2005-223263 | A | 8/2005 | |
| JP | 2007-039794 | A | 2/2007 | |
| JP | 2007-129105 | A | 5/2007 | |
| JP | 2007-235017 | A | 9/2007 | |
| JP | A 2009-76755 | | 4/2009 | |
| JP | 2011-091313 | A | 5/2011 | |
| JP | 2011-249774 | A | 12/2011 | |
| JP | 2012-069962 | A | 4/2012 | |
| WO | 2010/071111 | A1 | 6/2010 | |
| WO | WO 2011/032201 | A1 * | 3/2011 | H01F 1/08 |

OTHER PUBLICATIONS

Jul. 8, 2013 Partial European Search Report issued in European Application No. 13156391.8.
Jul. 24, 2013 Partial European Search Report issued in European Application No. 13173244.8.
Oct. 31, 2013 Extended European Search Report issued in European Application No. 13173244.8.
Nov. 7, 2013 Extended European Search Report issued in European Application No. 13156391.8.
Dec. 5, 2014 Extended European Search Report issued in European Application No. 14173515.9.
Jun. 25, 2015 Office Action issued in U.S. Appl. No. 13/778,608.
Nov. 13, 2015 Office Action issued in U.S. Appl. No. 13/923,842.
Jan. 6, 2016 Notice of Reasons for Rejection issued in Japanese Application No. 2012-040137.
Feb. 23, 2016 Notice of Reasons for Rejection issued in Japanese Application No. 2012-141803.
Jul. 8, 2013 Partial Search Report issued in European Patent Application No. 13 15 6393.4.
Mar. 23, 2016 First Office Action issued in Chinese Application No. 201310045955.4.
Nov. 1, 2016 Office Action issued in Japanese Patent Application No. 2012-141803.

* cited by examiner

METHOD OF MANUFACTURING MAGNET, AND MAGNET

INCORPORATION BY REFERENCE

The disclosure of Japanese Patent Application No. 2012-040137 filed on Feb. 27, 2012 including the specification, drawings and abstract is incorporated herein by reference in its entirety.

BACKGROUND OF THE INVENTION

1. Field of the Invention

The invention relates to a method of manufacturing a magnet, and a magnet.

2. Description of Related Art

Neodymium magnets (Nd—Fe—B magnets) have been used as high performance magnets. However, dysprosium (Dy), which is expensive and rare, is used to manufacture high performance neodymium magnets. Therefore, development of magnets that are manufactured without using dysprosium has been promoted recently. Sm—Fe—N magnets that are manufactured without using dysprosium are known. However, because the decomposition temperature of a Sm—Fe—N compound is low, it is difficult to subject the Sm—Fe—N compound to high temperature sintering. If the Sm—Fe—N compound is sintered at a temperature equal to or higher than the decomposition temperature, the compound is decomposed. This may cause a possibility that the magnet will not be able to exhibit its performance as a magnet. Thus, material powders of the compound are bonded by a bonding agent. However, using the bonding agent causes a decrease in the density of the material powders, which may be a factor of a decrease in the residual magnetic flux density.

Japanese Patent Application Publication No. 2009-76755 describes that rare earth-transition metal alloy powders are sintered by being irradiated with microwaves in a vacuum atmosphere or an inert gas atmosphere.

It is not easy to manufacture a magnet by irradiating a compact made of powders of Sm—Fe—N compound with microwaves. If the compact is irradiated with microwaves, microwave heating occurs in an outer face side portion of the compact irradiated with the microwaves and therefore the powders in the outer face side portion attempt to be bonded together. However, if the powders in the outer face side portion of the compact are bonded together, an inside portion of the compact is not irradiated with the microwaves and therefore the powders in the inside portion of the compact are not bonded together. As a result, the bending strength of the magnet becomes low. Further, if the outer face side portion of the compact is continuously irradiated with the microwaves, the temperature of the outer face side portion of the compact is increased beyond the decomposing temperature, resulting in reduction of the performance of the magnet.

SUMMARY OF THE INVENTION

It is an object of the invention to provide a method of manufacturing a magnet that is made of a hard magnetic material without using dysprosium, and which is capable of providing a magnet having a high bending strength in the case that the hard magnetic material is heated by irradiating microwaves thereto, and also to provide the thus formed magnet.

An aspect of the invention relates to a method of manufacturing a magnet from a hard magnetic material formed of material powders made of a R—Fe—N compound containing a light rare earth element as R, or material powders made of a Fe—N compound. The method includes: a forming step of forming a compact in which a density of the hard magnetic material powders differs between an outer face side portion and an inside portion of the compact such that a rate of progress of powder bonding due to microwave heating is higher in the inside portion of the compact than in the outer face side portion of the compact when an outer face of the compact is irradiated with microwaves; and a microwave heating step of irradiating the outer face of the compact with the microwaves to cause the microwave heating, thereby bonding the hard magnetic material powders by oxide films that are formed on the hard magnetic material powders.

BRIEF DESCRIPTION OF THE DRAWINGS

The foregoing and further features and advantages of the invention will become apparent from the following description of example embodiments with reference to the accompanying drawings, wherein like numerals are used to represent like elements, and wherein.

DETAILED DESCRIPTION OF EMBODIMENTS

Figure 1:
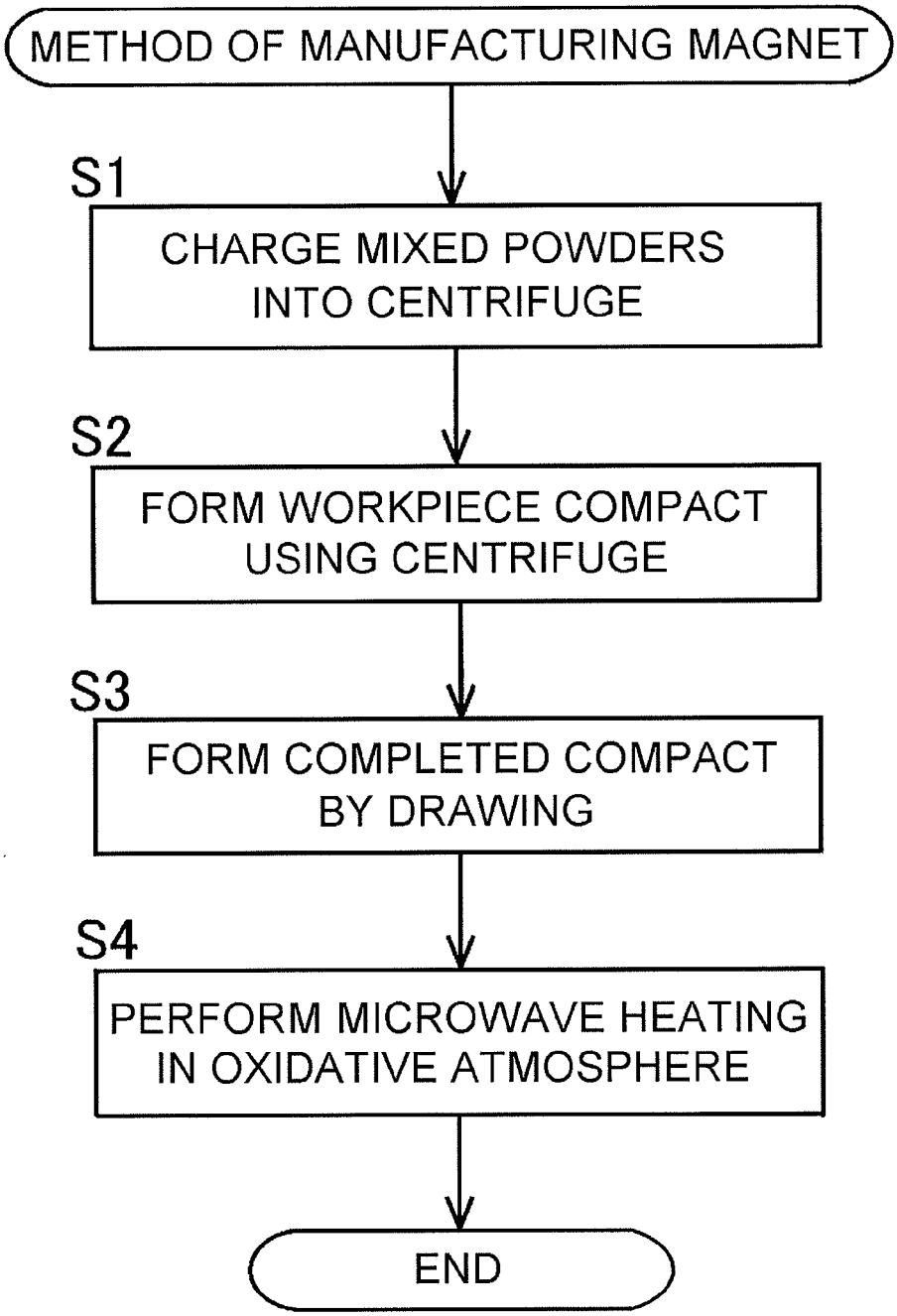
FIG. 1 is a flowchart that shows a method of manufacturing a magnet according to a first embodiment of the invention.

Hereinafter, a method of manufacturing a magnet according to a first embodiment of the invention will be described in detail with reference to FIG. 1 to FIG. 6. First, material powders 10 are compressed into a predetermined shape in a non-heated state. In the present embodiment, a centrifuge 100 is used to compress the material powders 10 into the predetermined shape. That is, the material powders 10 are charged into the centrifuge 100 (step S1).

In the present embodiment, only hard magnetic material powders 11, 12 are used as the material powders that are charged into the centrifuge 100. The materials that are charged into the centrifuge 100 do not contain, for example, a bonding agent. A R—Fe—Ne compound that contains a light rare earth element as R, or a Fe—N compound is used for the hard magnetic material powders 11, 12. Sm is suitable as the light rare earth element R. Namely, $Sm_2Fe_{17}N_3$ or $Fe_{16}N_2$ is suitably used as the hard magnetic material powders 11, 12. Note that, two or more types of powders that are different in particle size are used as the hard magnetic material powders 11, 12. For example, the hard magnetic material powders 11 having a large average particle diameter and the hard magnetic material powders 12 having a small average particle diameter are used. Accordingly, the hard magnetic material powder 11 having a large particle diameter is larger in mass than the hard magnetic material powder 12 having a small particle diameter. Note that the hard magnetic material powders 11, 12 are made of the same kind of compound.

Figure 2:
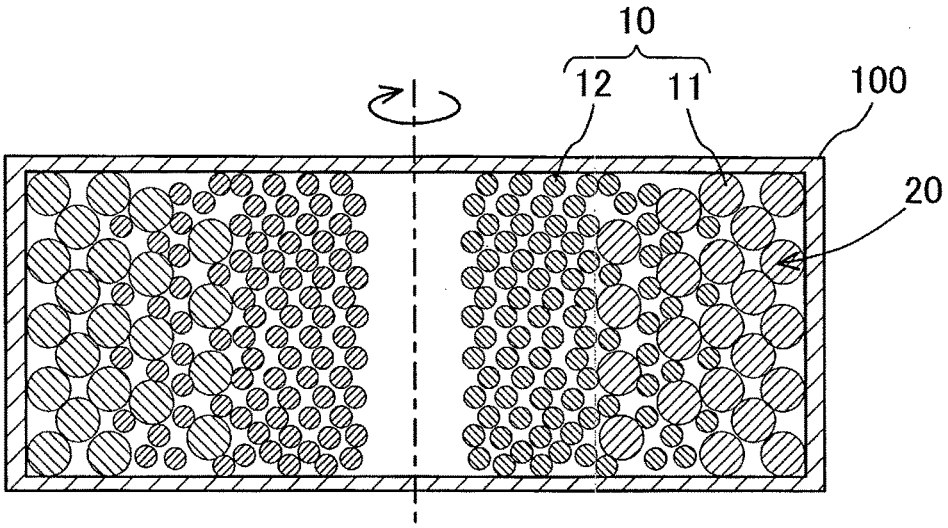
FIG. 2 is a schematic sectional view illustrating a workpiece compact that is formed by a centrifuge in step S2 in FIG. 1.

Next, the centrifuge 100 is driven to form a workpiece compact 20 in an oxidative atmosphere (step S2). The workpiece compact 20 is formed into a disc shape or a cylindrical shape. In the workpiece compact 20, the hard magnetic material powders 11, 12 are integrated such that the shape of the workpiece compact 20 is maintained. FIG. 2 shows an axial sectional view of the workpiece compact 20. As shown in FIG. 2, by driving the centrifuge 100, most of the powders having a large mass, on which a large centrifugal force acts, move radially outward, whereas most of the powders having a small mass move radially inward. Because the centrifuge 100 is used, a through-hole is formed at the center of the workpiece compact 20.

The powders 10 are in partial contact with each other while gaps are formed between the powders 10. The workpiece compact 20 is formed in an oxidative atmosphere. Therefore, gas of the oxidative atmosphere enters the gaps between the powders 10. When the hard magnetic material powders 11 having a large average particle diameter are located next to each other, the gaps between the powders 11 are relatively large. On the other hand, the hard magnetic material powders 12 having a small average particle diameter are located next to each other, the gaps between the powders 12 are relatively small. Therefore, in the workpiece compact 20, the density of the hard magnetic material in a radially inner side portion is higher than that in a radially outer side portion.

Figure 3:
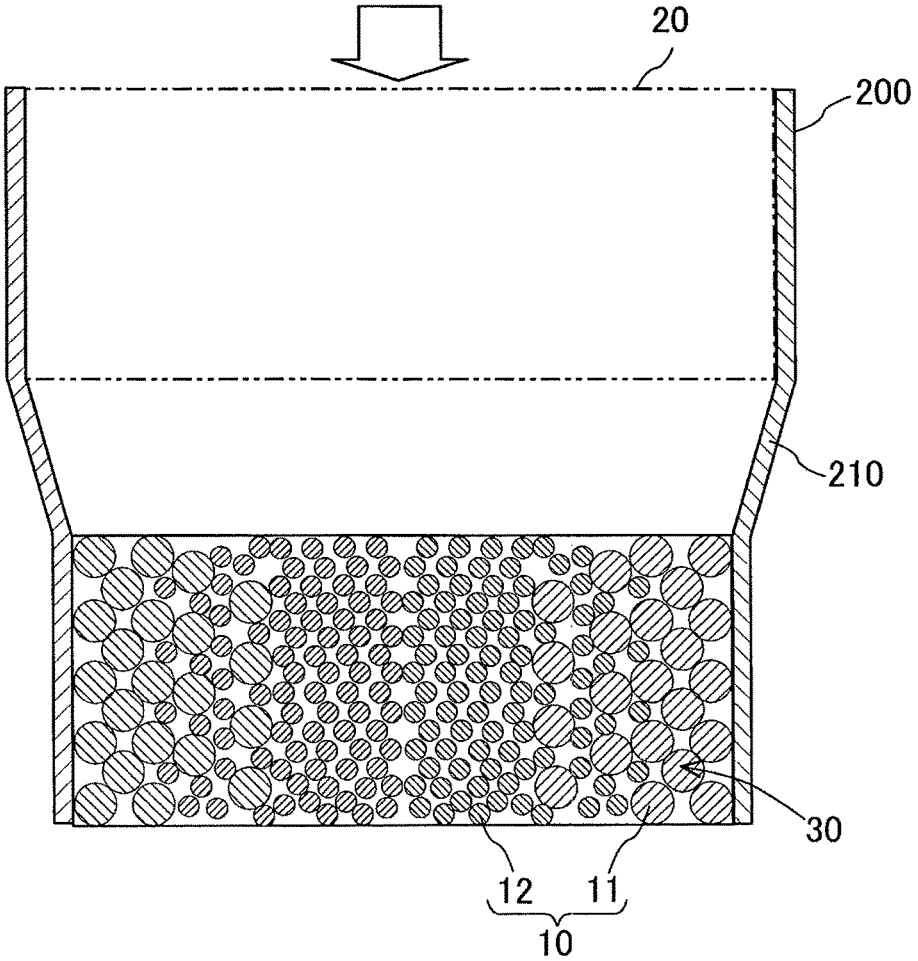
FIG. 3 is a schematic sectional view illustrating a completed compact formed by a drawing device in step S3 in FIG. 1.

Next, the outer diameter of the workpiece compact 20 is reduced by a drawing device 200 to fill in the through-hole at the center of the workpiece compact 20. Thus, a completed compact 30 having a disc shape or a cylindrical shape is formed (step S3). Specifically, the workpiece compact 20 is placed at the large diameter side of the drawing device 200, and is then axially pressurized so as to pass through a diameter reducing portion 210. In this way, the completed compact 30 is formed. As shown in FIG. 3, mainly the hard magnetic material powders 11 having a large average particle diameter are arranged in the radially outer side portion, that is, the outer face side portion of the completed compact 30, while mainly the hard magnetic material powders 12 having a small average particle diameter are arranged in the radially inner side portion, that is, the inside portion of the completed compact 30. Therefore, in the completed compact 30 as well as in the workpiece compact 20, the density of the hard magnetic material in the inside portion is higher than that in the outer face side portion.

Figure 6:
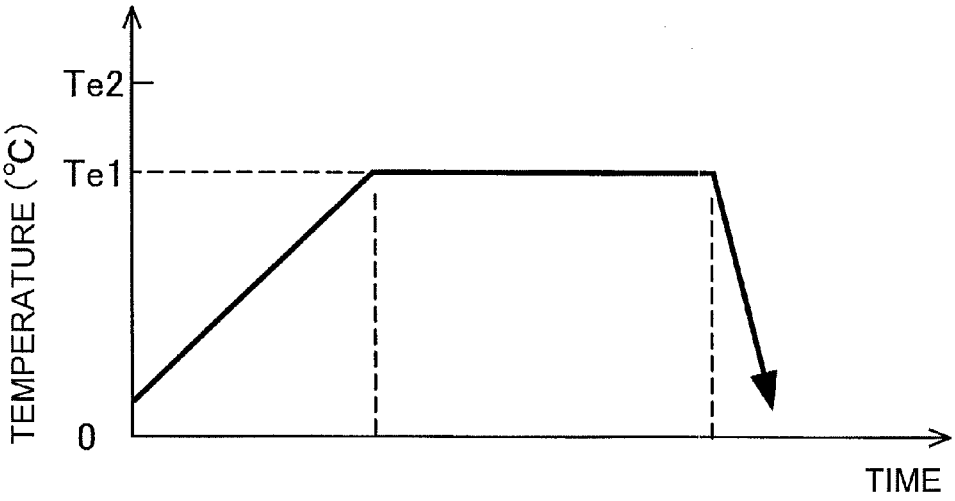
FIG. 6 is a process chart of the heating treatment in step S4 in FIG. 1.

Next, the completed compact 30 is heat-treated by microwaves in an oxidative atmosphere (step S4). The heating treatment is as shown in FIG. 6. A heating temperature Te1 achieved by the microwaves is set to a value lower than a decomposition temperature Te2 of the hard magnetic material powders 11, 12. For example, when the hard magnetic material powders 11, 12 made of $Sm_2Fe_{17}N_3$ or $Fe_{16}N_2$ are used, the decomposition temperature Te2 is approximately 500° C., and therefore the heating temperature Te1 is set lower than 500° C. For example, the heating temperature Te1 is set to approximately 200° C.

Further, as the oxygen content of the oxidative atmosphere, a value that is approximately equal to the oxygen content of the atmospheric is sufficient. Accordingly, the heating treatment may be performed in the atmosphere. If the heating temperature Te1 is set to approximately 200° C., oxide films may be formed in each of the case where $Sm_2Fe_{17}N_3$ is used and the case where $Fe_{16}N_2$ is used. The oxide films bond the hard magnetic material powders 11, 12 together. As a result, a magnet having a high bending strength is obtained.

The heating treatment for the completed compact 30 will be described in detail below. When the hard magnetic material powders 11, 12, which are dielectrics, are irradiated with microwaves, polarization occurs in the hard magnetic material powders 11, 12 irradiated with the microwaves, which causes microwave heating (induction heating by microwaves). The hard magnetic material powders 11, 12 are heated by the microwave heating, and oxide films are formed on the outer faces of the hard magnetic material powders 11, 12. Thus, the hard magnetic material powders 11, 12, which are located next to each other, are bonded to each other by the oxide films formed by the microwave heating.

Note that polarization occurs more easily as a relative permittivity becomes larger. That is, it is a known fact that the progress of microwave heating is faster in a material having a larger relative permittivity. Further, it is a known fact that the progress of microwave heating is faster as the density of a dielectric is higher.

Because the hard magnetic material powders 11, 12 that constitute the completed compact 30 are made of the material having the same property, the powders 11, 12 have the same relative permittivity. On the other hand, the density of the hard magnetic material in the inside portion of the completed compact 30 is higher than that in the outer face side portion of the completed compact 30. Therefore, when microwaves are applied to the completed compact 30 from its outer face side, the rate of progress of the microwave heating is higher in the inside portion of the completed compact 30 than in the outer face side portion thereof. As a result, the rate of bonding progress, that is, the rate of formation of oxide films by the microwave heating is higher in the inside portion of the completed compact 30 than in the outer face side portion thereof.

Figure 4:
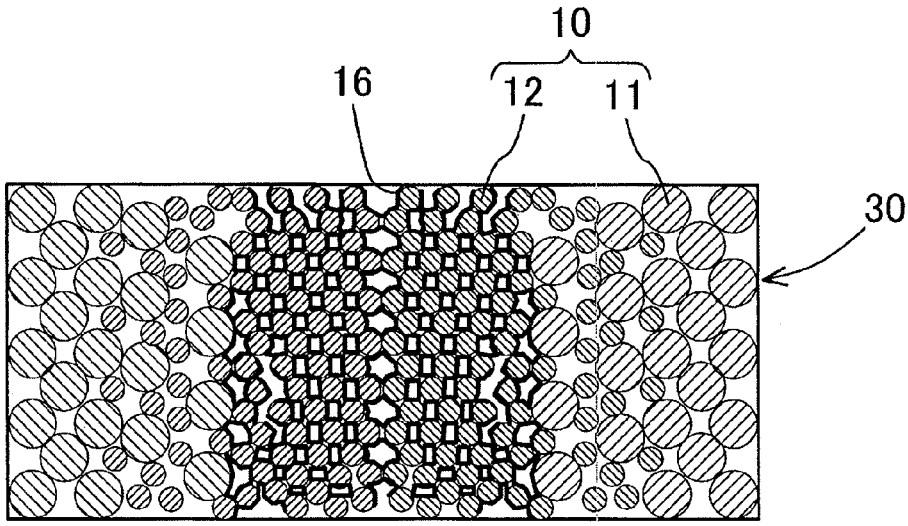
FIG. 4 is a schematic sectional view illustrating the completed compact during a heating treatment in step S4 in FIG. 1.
Figure 5:
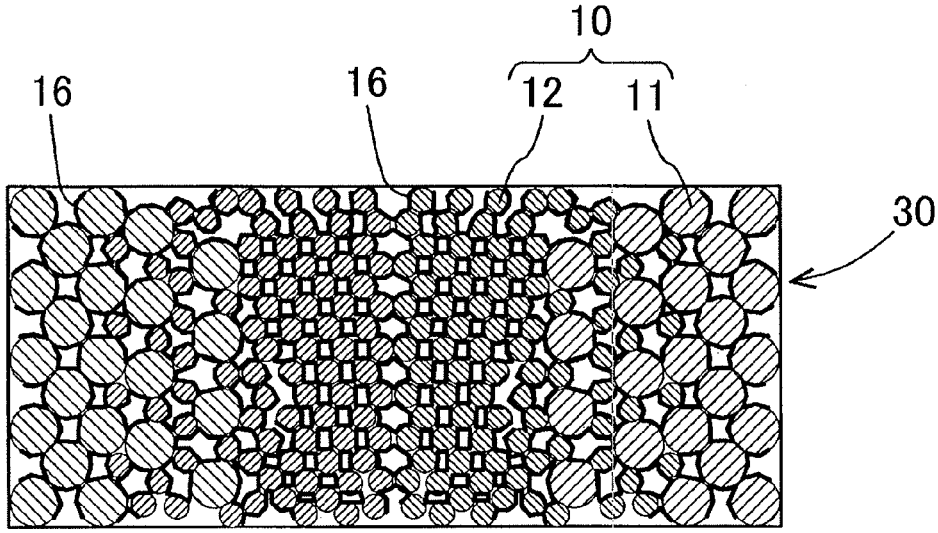
FIG. 5 is a schematic sectional view illustrating the completed compact at the completion of the heating treatment in step S4.

The completed compact 30 during the heating treatment is shown in FIG. 4, and the completed compact 30 at the completion of the heating treatment is shown in FIG. 5. As shown in FIG. 4, during the heating treatment, oxide films 16 are formed on the outer faces of the hard magnetic material powders 12 which are located in the inside portion of the completed compact 30. Accordingly, the hard magnetic material powders 12 that are located in the inside portion of the completed compact 30 are bonded together. At this time, no oxide films 16 have yet been formed in the outer face side portion of the completed compact 30 because the progress of microwave heating is slow in this portion.

By continuing the irradiation of microwaves, as shown in FIG. 5, the oxide films 16 are formed not only on the outer faces of the hard magnetic material powders 12 in the inside portion of the completed compact 30 but also on the outer faces of the hard magnetic material powders 11 in the outer face side portion of the completed compact 30. Accordingly, the hard magnetic material powders 11 in the outer face side portion of the completed compact 30 are also bonded together. As stated above, because the powders 10 are bonded together in the entirety of the completed compact 30 after the heating treatment. Therefore, it is possible to obtain a high bonding force. As a result, it is possible to obtain a high bending strength.

If heating of the powders 10 progresses earlier in the outer face side portion than in the inside portion and the oxide films 16 are formed earlier in the outer face side portion than in the inside portion, it is difficult for the microwaves to enter the inside portion of the completed compact 30. In some cases, the hard magnetic material powders 11, 12 are brought into partial contact with each other to produce electrical conductivity, and a shield function against the microwaves is fulfilled. In this case, it is difficult for the microwaves to enter the inside portion of the completed compact 30. If the microwave heating progresses from the outer face side portion of the completed compact 30, the oxide films 16 are not easily formed in the inside portion of the completed compact 30. This may cause a possibility that the bonding force in the inside portion of the completed compact 30 will be reduced.

However, as stated above, the rate of progress of the heating by the microwave heating is higher in the inside portion of the completed compact 30. Accordingly, the hard magnetic material powders 12 in the inside portion are reliably bonded together. Moreover, because the microwaves are applied to the outer face side portion of the completed compact 30, the hard magnetic material powders 11 in the outer face side portion of the completed compact 30 are, of course, bonded together by the microwave heating.

In the above-described embodiment, the centrifuge 100 is used in order to arrange the hard magnetic material powders 11 having a large particle size in the outer face side portion of the completed compact 30 and to arrange the hard magnetic material powders 12 having a small particle size in the inside portion thereof. This arrangement of the powders 11, 12 is easily achieved by using the centrifuge 100. However, the invention is not limited to this as long as it is possible to directly arrange the powders 11, 12 at desired positions.

A second embodiment of the invention will be described below. In the first embodiment, the magnet is manufactured from the hard magnetic material powders 11, 12 that are different in particle size but made of the same kind of compound. The powders 11, 12 are used as the material powders 10. Alternatively, as material powders 40, hard magnetic material powders 41 and soft magnetic material powders 42 made of an insulating material may be used. The hard magnetic material powders 41 are similar to the hard magnetic material powders 10 in the first embodiment. Note that the insulating material powders 42 are lower in relative permittivity than the above-described hard magnetic material, and are larger in mass per one particle than the hard magnetic material powders 41. Alternatively, the insulating material powders 42 are higher in relative permittivity than the above-described hard magnetic material, and are smaller in mass per one particle than the hard magnetic material powders 41.

In the present embodiment, the insulating material of the powders 42 is, for example, soft ferrite. Soft ferrite is lower in relative permittivity than $Sm_2Fe_{17}N_{13}$ and $Fe_{16}N_2$. The average particle diameter of soft ferrite is determined such that the mass per one particle of soft ferrite is larger than that of the hard magnetic material powders 41.

Figure 7:
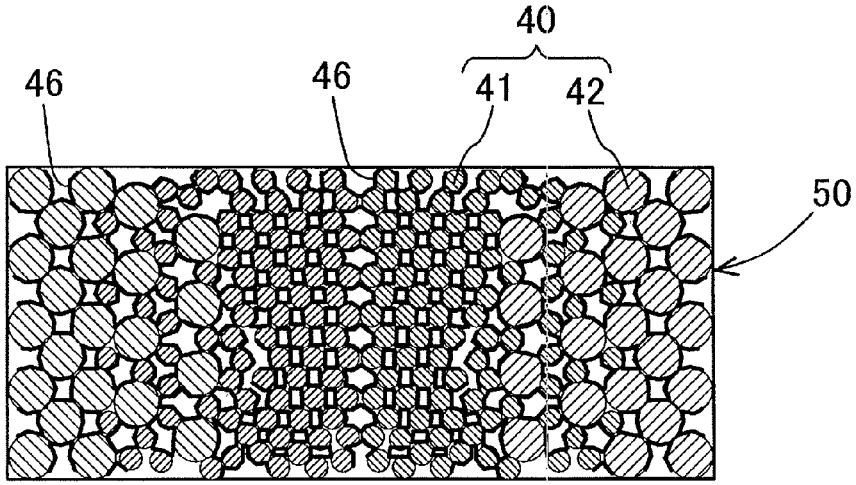
FIG. 7 is a schematic sectional view illustrating a completed compact after a heating treatment in a second embodiment of the invention.

Further, as in the above-described embodiment, after a workpiece compact is formed with the use of the centrifuge 100, a completed compact 50 (shown in FIG. 7) is formed with the use of the drawing device 200. The hard magnetic material powders 41 having a small mass per one particle are arranged in the inside portion of the completed compact 50. The insulating material powders 42 having a larger mass per one particle are arranged in the outer face side portion of the completed compact 50. That is, the material having a higher relative permittivity is arranged in the inside portion of the completed compact 50 whereas the material having a lower relative permittivity is arranged in the outer face side portion of the completed compact 50.

When microwaves are applied, polarization due to microwave heating occurs more easily in the material having a higher relative permittivity than in the material having a lower relative permittivity. That is, even when microwaves are applied to the completed compact 50 from the outer face side thereof, the rate of progress of bonding due to the microwave heating is higher in the inside portion of the completed compact 50 than in the outer face side portion thereof. Therefore, the oxide films 46 are reliably formed in the inside portion of the completed compact 50. By continuously applying microwaves, the oxide films 46 are formed also in the outer face side portion of the completed compact 50. Thus, the material powders 40 are bonded together in the entirety of the completed compact 50. Therefore, it is possible to obtain a high bonding force. As a result, it is possible to obtain a high bending strength.

Further, by setting the relationship between the mass per one particle of the hard magnetic material powders 41 and the mass per one particle of the insulating material powders 42 as stated above, the powders 41 and the powders 42 are easily arranged in the inside portion and the outer face side portion of the completed compact 50, respectively, with the use of the centrifuge 100. Further, by using a soft magnetic material as the material of the powders 42, a sufficiently high performance as a magnet is fulfilled.

In the above-described embodiment, the insulating material powders 42 are higher in relative permittivity than the above-described hard magnetic material, and are smaller in mass per one particle than the hard magnetic material powders 41. In this case, with the use of the centrifuge 100, the insulating material powders 42 are arranged in the inside portion of the completed compact 50 whereas the hard magnetic material powders 41 are arranged in the outer peripheral side thereof. In this case as well, because the relative permittivity of the insulating material that is arranged in the inside portion of the completed compact 50 is higher than that of the material arranged in the outer surface portion of the completed compact 50, polarization by the microwave heating reliably progresses from the inside portion of the completed compact 50. As a result, the powders are bonded together in the entirety of the completed compact 50.

When the powders 41, 42 are directly arranged at desired positions without using the centrifuge 100, the relationship in mass between the powders 41 and the powders 42 is not limited to the one described above. For example, there may be employed a configuration in which a material having a higher relative permittivity is arranged in the inside portion of the completed compact 50 and a material having a lower relative permittivity is arranged in the outer face side portion of the completed compact, irrespective of their masses.

What is claimed is:

1. A method of manufacturing a magnet, comprising:

a forming step of forming a raw material into a compact, the raw material comprising a hard magnetic material powder and no bonding agent, the hard magnetic material powder being:

a R—Fe—N compound, where R is a light rare earth element; or a Fe—N compound;

in which a density of the hard magnetic material powder differs between an outer face side portion and an inside portion of the compact such that a rate of progress of powder bonding due to microwave heating in an oxidative atmosphere is higher in an inside portion of the compact than in an outer face side portion of the compact when the outer face of the compact is irradiated with microwaves; and a microwave heating step of heating the compact by irradiating the outer face of the compact with microwaves in an oxidative atmosphere until particles of the hard magnetic material powder are bonded together throughout the compact by oxide films that are formed on the particles of the hard magnetic material powder, wherein, in the forming step:

the hard magnetic material powder comprises:

first hard magnetic material particles having a first average particle diameter, and second hard magnetic material particles having a second average particle diameter that is smaller than the first average particle diameter, the first hard magnetic material particles and the second hard magnetic material particles being composed of the same material; and the hard magnetic material powder is arranged in the compact such that that the density of the hard magnetic material powder is higher in the inside portion of the compact than in the outer face side portion of the compact, and wherein, in the forming step, the compact is formed using a centrifuge such that the second hard magnetic material particles are arranged in the inside portion of the compact and the first hard magnetic material particles are arranged in the outer face side portion of the compact.

2. A method of manufacturing a magnet, comprising:

a forming step of forming a raw material containing no bonding agent into a compact, the raw material comprising:

a first compound having a first relative permittivity; and a second compound having a second relative permittivity that is greater than the first relative permittivity;

wherein the second compound is arranged in an inside portion of the compact and the first compound is arranged in an outer surface portion of the compact; and a microwave heating step of heating the compact by irradiating the outer face of the compact with microwaves in an oxidative atmosphere until particles of the first and second compounds are bonded together by oxide films that are formed on the particles of the first and second compounds throughout the compact;

wherein:

the first compound is a hard magnetic material powder composed of:

a R—Fe—N compound, where R is a light rare earth element; or a Fe—N compound; and the second compound is an insulating material powder; or the second compound is a hard magnetic material powder composed of:

a R—Fe—N compound, where R is a light rare earth element; or a Fe—N compound; and the first compound is an insulating material powder, wherein:

in the forming step, a centrifuge is used to form the compact;

the first compound has a first average mass per particle; and the second compound has a second average mass per particle that is less than the first average mass per particle.

3. The method according to claim 2, wherein the insulating material is a soft magnetic material.

* * * * *